US006733349B2

(12) United States Patent
Chun

(10) Patent No.: US 6,733,349 B2
(45) Date of Patent: May 11, 2004

(54) JET PROPULSION BOAT

(76) Inventor: Andrew Chun, 8106 215th Pl. SW., Edmonds, WA (US) 98026

( * ) Notice: Subject to any disclaimer, the term of this patent is extended or adjusted under 35 U.S.C. 154(b) by 0 days.

(21) Appl. No.: 10/066,956

(22) Filed: Mar. 28, 2002

(65) Prior Publication Data

US 2003/0186598 A1 Oct. 2, 2003

(51) Int. Cl.[7] ..... B63H 11/00
(52) U.S. Cl. ..... 440/38; 114/144 R; 114/162
(58) Field of Search ..... 114/144 R, 162–165; 440/38, 40, 43, 47, 51, 68–72; 60/221, 222

(56) References Cited

U.S. PATENT DOCUMENTS 1,382,170 A * 6/1921 Conti ..... 114/167
1,795,596 A * 3/1931 Fleming et al. ..... 440/40
3,068,828 A * 12/1962 Ellis ..... 114/294
3,249,081 A * 5/1966 Schuster ..... 114/152
3,623,447 A * 11/1971 Jacobson ..... 114/55.51
3,827,392 A * 8/1974 Jones ..... 114/55.57
D241,025 S * 8/1976 Jacobson ..... D12/307
4,141,309 A * 2/1979 Halboth ..... 114/283
4,382,796 A * 5/1983 Blanchard ..... 440/51
4,781,141 A * 11/1988 Webb et al. ..... 114/288
D301,029 S * 5/1989 Duclo et al. ..... D12/312
D343,380 S * 1/1994 Wortham ..... D12/306
5,405,276 A * 4/1995 Kato ..... 440/38
5,567,188 A * 10/1996 Allebosch ..... 440/38
6,406,339 B1 * 6/2002 Sills ..... 440/38

* cited by examiner

*Primary Examiner*—S. Joseph Morano
*Assistant Examiner*—Ajay Vasudeva

(57) ABSTRACT

A jet propulsion boat having a longitudinally disposed tunnel comprises a drive unit for powering a screw propeller, and a pressure chamber with a constricting passage for housing the propeller. The pressure chamber has an upper half section integral with the boat hull, and a lower half section detachably mounted to the upper half section with bolts. A steering wheel assembly with a steering wheel and a steering post is supported in a vertical orientation on a top surface of the drive unit for manipulating a rudder, which is disposed at the stern behind the exhaust opening of the pressure chamber. The rudder is manipulated by means of bevel gears and a transmission shaft. The drive unit may be detachably mounted on the hull for ease in transportation.

4 Claims, 3 Drawing Sheets

JET PROPULSION BOAT

BACKGROUND OF THE INVENTION

This invention as the jet propulsion boating elements is very much related with my first U.S. Pat. No. 4,341,058 "Exercycle Mower Apparatus" granted on Jul. 27, 1982 and the Second and third U.S. Pat. No. 4,657,514 "Amphibious Pedal Powered Sailboat" on Apr. 14, 1987.

That is, in 1982 while developing the gearing system of the Exercycle Mower, it was found the fact that the minimum revolutions of the grass cutting blade required 900 r.p.m. whereas subsequently the gearing mechanism was settled with the design of 1,040 r.p.m. which is equivalent to the small capacity of a outboard Gas engine; and that during the period of developing the invention "Amphibious Pedal Powered Sail Boat", it was found that the stern of the boat hull molded with fiberglass reinforced resin is comprised with the perpendicularly projected screw propeller stand firmly holding with a seal bearing box and upper half round cavity covering screw propeller whereby the round cavity behind the screw propeller significantly affected to enhance efficiency of its thrusting power, while reducing propeller noise as compared with a outboard motor boat. As such that, the present invention of the jet propulsion inboard boat is merited with the intensive research achievements during the development of the previously U.S. patented inventions including the "Pedal Powered Exercycle Mower" and the "Pedal Powered Sailboat.

The present invention of inboard boat is provided with the Pressure Chamber in the stern of the hull, and the screw propeller is installed in the forward section of the Pressure Chamber with the propeller shaft that is supported by the Seal Bearing Box firmly fixed at the lower part of the screw propeller stand protruded from the central part of the boat hull whereby to connect the screw propeller shaft with the shaft of the Drive Power Unit. As such that, this invention of the inboard boat is remarkably distinguished from other inboard boat in the following facts: 1) the boat hull has a hollow cavity running from the central part of the hull to the end of the stern, 2) the Pressure Chamber is comprised of the upper part and lower part, and the upper part is processed together with the boat hull and the lower part separately processed is joined with the upper part by bolts and nuts, and 3) the screw propeller is placed at the point right inside of the inlet opening of the Pressure Chamber, whereby the propeller is well protected from possible damage by rocks or other things in the water.

In this context, numerous research was carried out through the web side in domestic and world wide, however, there were no significant answers to the query—only saying that there is a remarkable improvement in the field of airplane jet propulsion, but no significant development in jet propulsion boating. Although the applicant of the present invention searched through the internet of www.uspto.gov/ with use of paraphrases such as "Jet Propulsion Pedal Boat" and "Jet Propulsion Motor Boat" that were responded with "No patents have matched with your query."

SUMMARY OF THE INVENTION

The present invention of the Jet Propulsion boat has a boat bull molded with use of reinforced plastic materials in which the bow section is provided with sailing device, the central section of the hull longitudinally along the keel is hollowed that is gently curved and elevated to have the Drive Power Unit Housing Device precisely balanced in order to link the drive power mechanism shaft with the screw propeller shaft which is supported by the Seal Bearing Box that is firmly based at the lower part of the propeller stand perpendicularly projected downward at the inlet opening of the Pressure Chamber comprising of in two parts—upper part and lower part—the upper part combined with the hull and the lower part detachably fixed to the upper part thus shaping cylinder with the constricted exhaust opening in the stern of the hull where it is facing the rudder the shaft of which is manipulated by means of bevel gears and transmission shaft that is handled by the steering wheel standing on the Drive Power Housing Device. Since the boat hull is formed with the upper part of the pressure chamber, the lower part detachably is joined together with the upper part with bolts and nuts whereby to function not only for pressure chamber but also for protection of the screw propeller with no worry of crushing damage while in operation.

The present invention is designed to operate the inboard boat by means of three drive power sources such as the pedal powered mechanism, D.C. motor and Gas engine, each respectively provided with the hollowed rail tracks on both sides longitudinally at the lower part of a drive power unit thus matched with the protruded rails on the Drive Power Unit Housing Device and tightened to it with use of the Drive Power Unit Holding Bolt. When car topping, the drive power unit can be detached from the boat hull, and at the launching site the drive power unit is combined with the housing device through the sliding means thereon and tightening it with the bolt thereof, and then the boat is launched on the water by means of couple of the transport wheels at the boat end, and while in operation on the water, the jet propulsion system makes less noise and functioning with powerful thrusts that create appropriate reactions to propel the boat. At present it is found that the pedal power mechanism is possible to activate propelling function to the same level of a small D.C. motor and Gas engine capacities, because the D.C. motor can make about 40 lbs./m thrust and Gas engine with about 1,000 r.p.m.

DESCRIPTION OF PREFERRED EMBODIMENT

Figure 1:
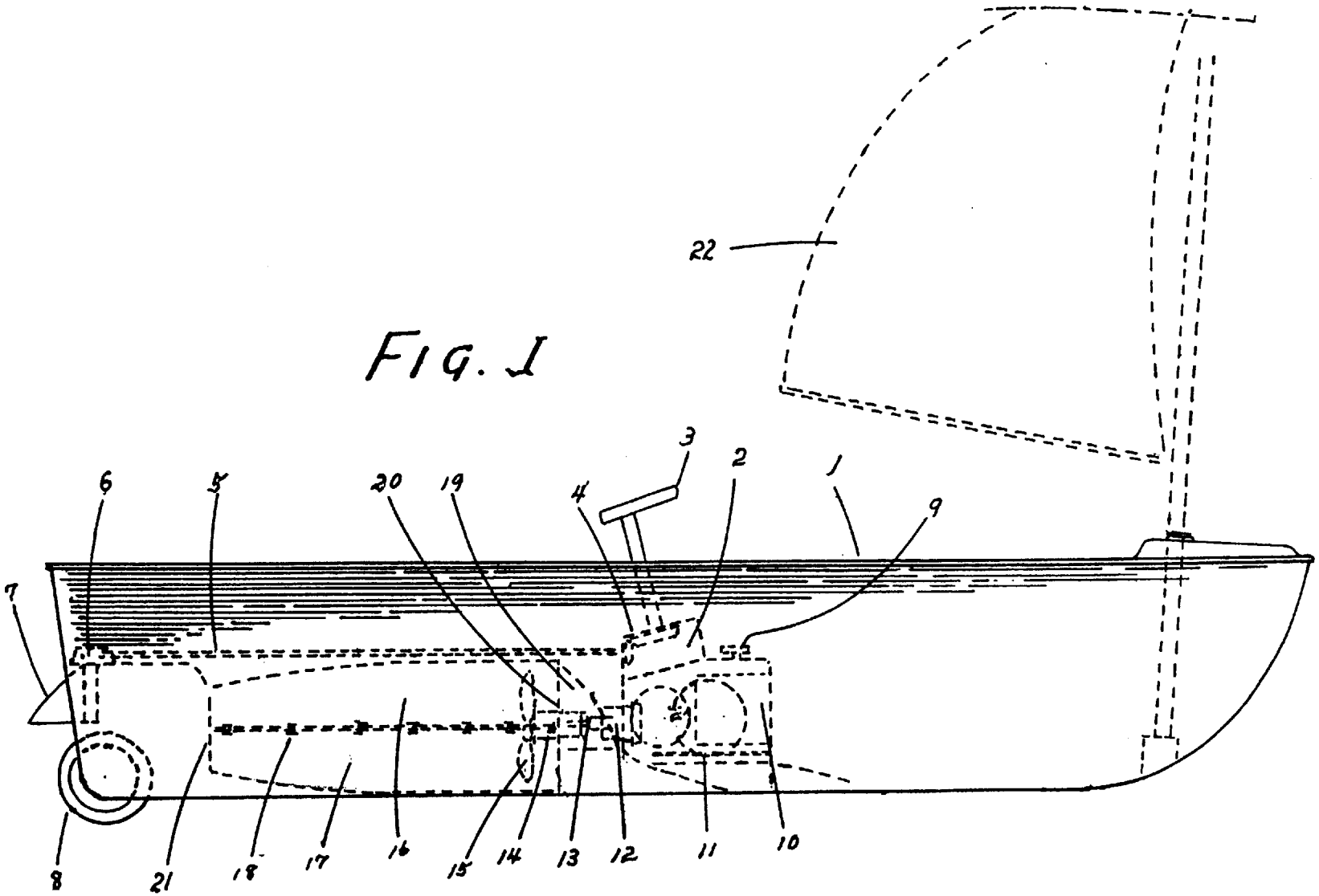
FIG. 1 is partly depicting the previous patent of "Amphibious Pedal Powered Sailboat" with Sail (22), Steering Wheel (3) and Rudder (7), and others shown thereon are related with the present invention of the Jet Propulsion Boat.
Figure 2:
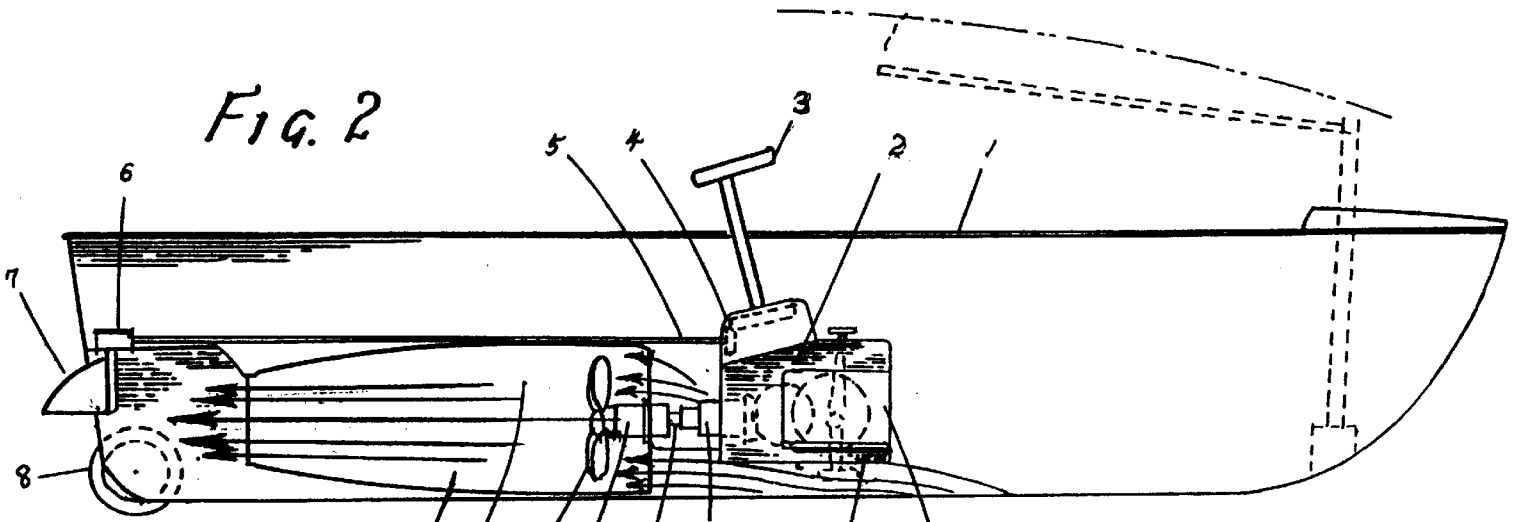
FIG. 2 is the elevated cross sectional longitudinal side view of the present invention with the thin arrows and thick arrows around the pressure chamber; that is, the thin arrows are automatic water flow into the Inlet Opening of the pressure chamber, and the thick arrows are showing forceful exertion of screw-propelled water through the constricted exhaust opening.
Figure 3:
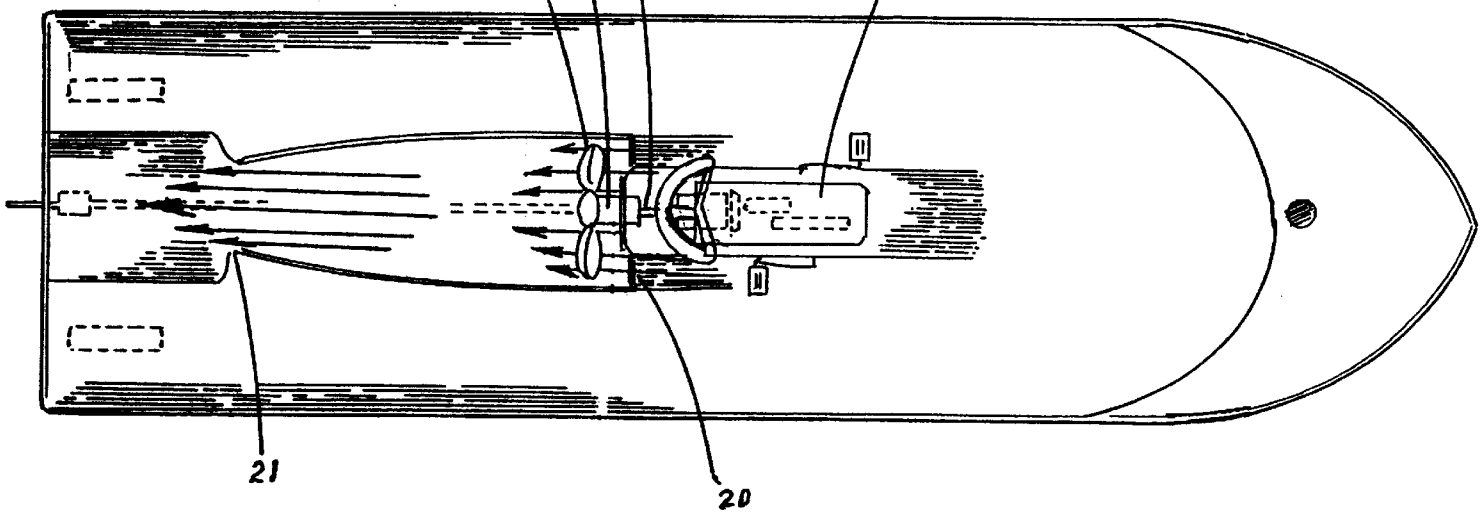
FIG. 3 is the top view of the present invention with the same effects as those of the FIG. 2 showing the activation of the Jet Propulsion within and around the pressure chamber.
Figure 4:
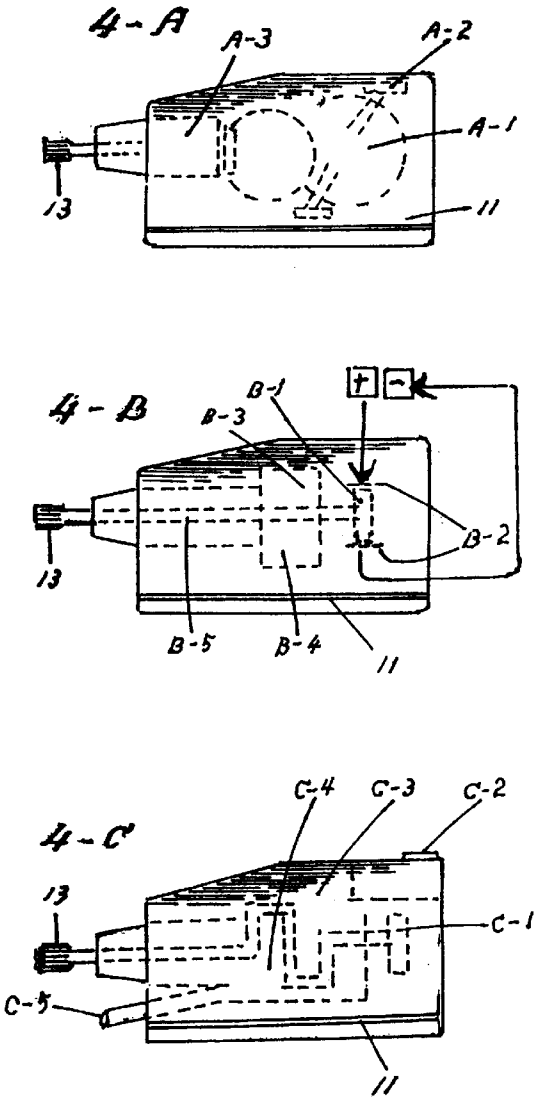
FIG. 4 is the cross sectional elevated partial side view of the present invention depicting the Drive Power Unit Housing Device with the related drawings: such as 4-A—the pedal powered gearing mechanism, 4-B—the D.C. motor mechanism and 4-C—the Gas engine mechanism.
Figure 4:
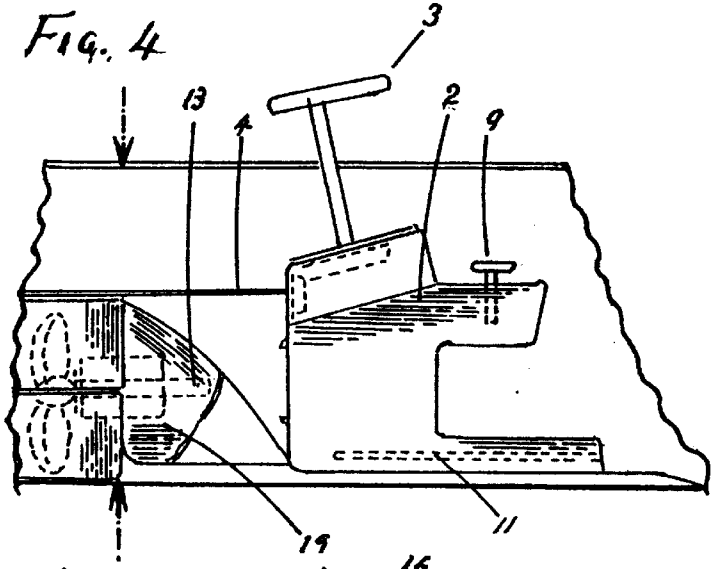
Figure 5:
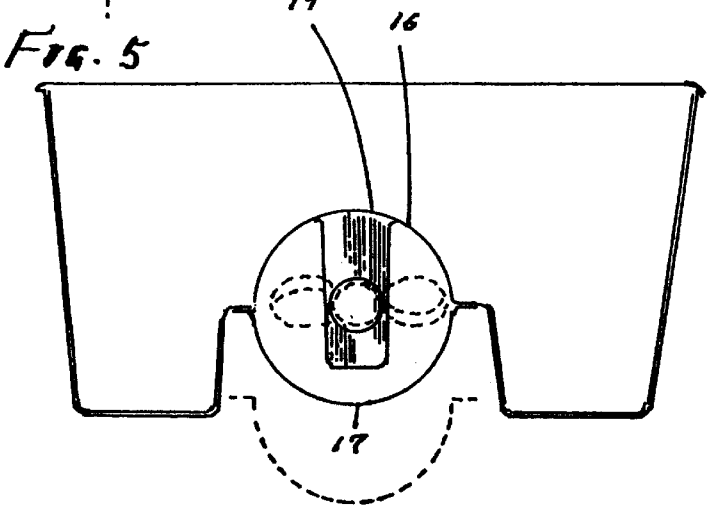
FIG. 5 is the cross sectional view of the present invention as with the crossing arrow marks on FIG. 4.

This invention of the Jet Propulsion boat has been deeply related with the inventor's previous patents granted in 1982 and 1987 by the U.S. Patent Office, because of his concentration and ardent efforts to improve the efficiency of the boat operation thereafter. When the inventor was attracted to the phrase "Jet Propulsion", he started intensive research navigation through the internet, and found strong possibility to improve his U.S. patented boat transforming into a jet propulsion boat for which he has found strong possibility by forming the pressure chamber in the stern right underneath the hull that is shaped with the longitudinally hollowed cavity running from the central part of the boat to the end of the stern. In addition, the drive power unit, selectively among the three sources such as Pedal Powered Mechanism, D.C. Motor and Gas engine, is detached while transporting the boat for car topping, and at launching site it is easily assembled to the Drive Power Unit Housing Device (2) that is permanently based at the central part of the boat. As shown on FIGS. 4 and 5, the screw propeller stand (19) is protruded from the hull perpendicularly downward in L-shape where the screw propeller (15) is installed with the propeller shaft (13) that is supported by the seal bearing box (14). The end of the screw propeller shaft (13) is grooved to be matched with the female grooved end of the drive power unit shaft (12). The Drive Power Unit housing device (2) is fixedly installed on the elevated hollow base of the boat hull thus to connect the Drive Power Shaft (12) with the propeller shaft (13). The Pressure Chamber (20) consists of with the upper part (16) and the lower part (17); the lower part is detachably joined with the upper part by means of bolts and nuts (18), and the cylindrical channel of the Pressure Chamber (20 has a constricted Exhaust Opening (21) at its end in the stern.

Since the inlet opening of the Pressure Chamber (20) is linked with the smoothly curved cavity across the underneath of the Drive Power Unit Housing Device (2), it is ideal for inflowing water when the screw propeller is put in operation while creating pressure allover the Pressure Chamber wall which then forcing the pressured water in the chamber out through the Exhaust Opening (21) causing thrusting power that creates reaction subsequently to propel the boat, that is called the Jet Propulsion.

With the present invention, it is possible to use plastic screw propeller with blades of higher thrusting efficiency, because the screw propeller of the present invention is safely protected while in operation under the water with the lower part of the pressure chamber that covers the screw propeller, and in addition the plastic propeller is easily available at lower cost in the market, and the weight of the propeller is about one pound for small boat; it is not comparable with expensive bronze propeller which weighs more than five times of the plastic product.

I claim:

1. A jet propulsion boat comprising:

a hull having a bow, a stern and a central region disposed midway between the bow and the stern, a longitudinally disposed tunnel extending from the central region of the boat to the stern;

a gasoline powered drive unit slidably mounted in the central region of the hull;

a steering post supported in substantially vertical orientation on a top surface of the drive unit, and a steering wheel mounted on a top end of the steering post;

a propeller shaft powered by the drive unit and extending through the hull into the tunnel, and a propeller mounted on a rear end of the propeller shaft;

a pressure chamber positioned within the tunnel for housing the propeller and comprising upper half and lower half sections, the upper half section being integral with the boat hull, the lower half section being detachably mounted to the upper half section with bolts, wherein the pressure chamber has a constricting passage from an inlet opening to an exhaust opening; and a rudder disposed at the stern behind the exhaust opening of the pressure chamber, the rudder being manipulated by the steering wheel by means of bevel gears and transmission shaft.

2. The jet propulsion boat of claim 1, wherein a screw propeller stand protrudes downwardly from the hull to hold the propeller shaft that is supported by the seal bearing box, wherein the propeller shaft has grooved end to connect with the grooved end of a drive axle of the drive unit.

3. The jet propulsion boat of claim 1, wherein boat hull is made with reinforced plastic.

4. The jet propulsion boat of claim 1, wherein the drive unit is slidably mounted on rails disposed on the hull.

* * * * *